US006645909B2

(12) United States Patent
Fujita et al.

(10) Patent No.: US 6,645,909 B2
(45) Date of Patent: Nov. 11, 2003

(54) PROCESS FOR AZO COUPLING REACTION USING DIAZONIUM SALT AND COUPLER HAVING RELEASING GROUP, AND RECORDING MATERIAL CONTAINING THE COUPLER

(75) Inventors: Akinori Fujita, Shizuoka-ken (JP); Tetsunori Matsushita, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 76 days.

(21) Appl. No.: 09/983,856

(22) Filed: Oct. 26, 2001

(65) Prior Publication Data

US 2002/0077252 A1 Jun. 20, 2002

(30) Foreign Application Priority Data

Oct. 27, 2000 (JP) ..... 2000-329496

(51) Int. Cl.[7] ..... B41M 5/30
(52) U.S. Cl. ..... 503/201; 503/217
(58) Field of Search ..... 503/216, 217, 503/201

(56) References Cited

U.S. PATENT DOCUMENTS 5,091,291 A 2/1992 Lau et al.

FOREIGN PATENT DOCUMENTS

JP 6-297857 A 10/1994

OTHER PUBLICATIONS

Stiles, Martin et al., "A Convenient General Method for the Preparation of Aldehydes", The Journal of Organic Chemistry, Oct. 13, 1960, pp. 1691–1693, vol. 25, No. 10, American Chemical Society.

Colonna, Martino et al.. "Electrophilic ipso–Substitutions. Part 2.[1] Reactions of 3–Substituted Indoles and 4–Substituted NN–Dimethylanilines with Arendiazonium Ions", J.C.S. Perkin, Trans. 2, 1982, pp. 455–459.

*Primary Examiner*—Bruce Hess
(74) *Attorney, Agent, or Firm*—Sughrue Mion, PLLC

(57) ABSTRACT

A process for an azo coupling reaction is provided that has a large coupling reaction rate and an excellent coloring density and exerts high coupling activity using a stable coupler, and a recording material containing the coupler is provided. The process for an azo coupling reaction comprises carrying out a coupling reaction of a diazonium salt and a coupler to make the diazonium salt form color, and the coupler has certain specified structures.

18 Claims, No Drawings

PROCESS FOR AZO COUPLING REACTION USING DIAZONIUM SALT AND COUPLER HAVING RELEASING GROUP, AND RECORDING MATERIAL CONTAINING THE COUPLER

BACKGROUND OF THE INVENTION

1. Field of the Invention

The present invention relates to a process for a diazo color formation reaction and a recording material utilizing the same, and more particularly, it relates to a process for an azo coupling reaction having a large reaction rate to realize quick color formation, and a recording material having a large color formation rate utilizing the reaction.

2. Description of the Related Art

Many reports have been made with respect to a reaction using a coupler and a diazonium salt and a recording material utilizing the color formation reaction. However, there are very few examples that use a coupler having a releasing group at the coupling site.

For example, *J. Chem. Soc., Perkin Trans.,* 2 (1982) discloses a coupling reaction of an indole coupler having a releasing group at the coupling site and a p-nitrobenzene diazonium salt. However, the coupler having a releasing group introduced exhibits a remarkably low coupling rate in comparison to a non-substituted compound.

JP-A-6-297857 discloses an azo coupling reaction of a naphthol coupler having a dimethylaminomethyl group at the coupling site and a benzene diazonium salt. However, the color formation reaction has a problem in that a sufficient dye density cannot be obtained.

In addition to these report, it has been the general recognition that in the diazo color formation reaction system, introduction of a releasing group at the coupling site lowers the coupling activity.

Furthermore, a coupler having a releasing group has been widely studied and reported in many articles with respect to a coupler for photographic purposes using silver halide (for example, as described in *Kaitei Shashin Kougaku no Kiso, Gin'en Shashin hen* (Basis of Photographic Engineering, Revised Edition, Volume for Silver Halide Photograph), published by Corona Publishing Co., Ltd.

However, the releasing groups in the reports relating to a recording material using silver halide are defined as groups that can be released through reaction with an oxidized product of a coloring developing agent, such as quinone diimine. However, there have been no reports describing a compound having a group that can be released through reaction with a diazonium salt.

In the color formation reaction using a reaction of a coupler and a diazonium salt, the color formation reaction rate (i.e., the coupling rate) is one of the important characteristic features. For example, in a heat-sensitive recording material using a diazonium salt, a certain degree of speed of the reaction rate in azo coupling is demanded from the standpoint of practical recording rate. In general, the coupling rate is roughly defined by the skeleton of the coupler as assuming that the same diazonium salt is used. Therefore, the coupling rate can be increased by appropriately changing the species of the substituents on the positions other than the coupling site, but the stability of the coupler is then lowered to cause various problems. For example, a heat-sensitive recording material suffers a problem in that the exposure coloring on the background part of a coupler having a good reaction rate tends to be increased.

Consequently, the coupling activity and the stability of the coupler tend to counter each other. Therefore, such a method has not yet been found that is effective to greatly improve the coupling activity of a certain coupler skeleton without greatly impairing the stability of the coupler.

SUMMARY OF THE INVENTION

The present invention has been developed to solve the problems associated with the conventional techniques described in the foregoing and to attain the following object.

An object of the present invention is to provide a process for an azo coupling reaction with high coupling activity using a stable coupler having a large reaction rate and an excellent coloring density, and also is to provide a recording material containing the coupler excellent in stability and reaction rate by utilizing the process for azo coupling reaction.

The inventors have found that the object is attained by a process for a diazo color formation reaction using the following coupler having a releasing group and a recording material containing the coupler, and thus the invention has been completed.

The process for an azo coupling reaction of the present invention comprises carrying out a coupling reaction of a diazonium salt and a coupler to make the diazonium salt form color, the coupler having one of the structures represented by the following general formulae (1), (2) and (3):

(1)

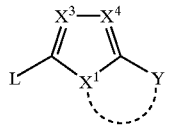

(2)

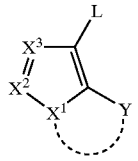

(3)

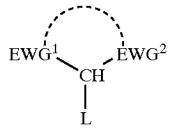

wherein $X^1$, $X^2$, $X^3$ and $X^4$ each independently represents an atomic group necessary for forming a 5-membered aromatic heterocyclic ring; Y represents an amino group, a substituted amino group, a hydroxyl group, an alkoxy group, an alkyl group, which may have a substituent, provided that $X^1$ and Y may be combined to form a heterocyclic ring; L represents a substituent capable of being released as a carbonium ion upon coupling with the diazonium salt; and $EWG^1$ and $EWG^2$each independently represents an electron withdrawing group, provided that $EWG^1$ and $EWG^2$ may be combined to form a heterocyclic ring.

It is preferable that the substituent represented by L of the coupler is a substituent represented by the following general formula (4):

$$—CHR^1R^2$$

wherein at least one of $R^1$ and $R^2$ contains an electron sourse capable of stabilizing a carbonium ion by resonance, i.e., a heteroatom having an unpaired electron.

It is preferable that the 5-membered heterocyclic ring of the coupler having a structure represented by the general formula (1) or (2) is one of a pyrrole ring, a pyrazole ring and an imidazole ring.

It is preferable that $EWG^1$ and $EWG^2$ of the coupler having a structure represented by the general formula (3) each is a carbonyl group.

It is preferable that the diazonium salt as the other component involving the azo coupling reaction of the invention is a benzene diazonium salt represented by the following general formula (5):

(5)

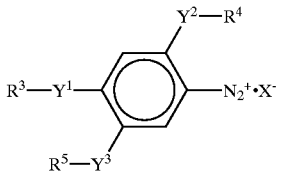

wherein $R^3$, $R^4$ and $R^5$, which may be the same or different, each independently represents an alkyl group, an aryl group, an aralkyl group, an alkenyl group, a heterocyclic group or an acyl group; $Y^1$ represents an oxygen atom, a sulfur atom or an amino group; $Y^2$ represents an oxygen atom or a sulfur atom; $Y^3$ represents an oxygen atom, a sulfur atom or a hydrogen atom, provided that when $Y^3$ represents a hydrogen atom, $R^5$ is not present; and $X^-$represents an anion.

In the process for an azo coupling reaction of the present invention, it is preferable that a reaction rate of the reaction k is 0.1 ($s^{-1}$) or more. When the process for an azo coupling reaction of the present invention is employed, the color formation reaction of the diazonium salt and the coupler effectively proceeds owing to the excellent stability and the large reaction rate, and thus the coloring density of the diazonium salt used is sufficiently exerted. When the coloring rate is small, on the other hand, the probability of inactivation of the diazo compound with the lapse of time during the reaction increases, and thus sufficient coloring density is difficult to be obtained.

The recording material of the present invention comprises a coupler having one of the structures represented by the following general formulae (1), (2) and (3), and a diazonium salt capable of coloring through a coupling reaction with the coupler.

As preferable embodiments of the recording material, it is preferable that the diazonium salt is encapsulated in microcapsules, and it is more preferable from the standpoint of reactivity that an emulsion containing the coupler contains an organic base.

DESCRIPTION OF THE PREFERRED EMBODIMENTS

A process for an azo coupling reaction of the present invention using a diazonium salt and a coupler having a releasing group, and a recording material containing the coupler will be described below.

Process for Azo Coupling Reaction

Coupler Having Releasing Group

When a coupler that is coupled with a diazonium salt in an ordinary method for an azo coupling reaction is represented by the following general formula (6), the group that contributes to the reaction is —H. Upon applying the expression to the process for an azo coupling reaction of the present invention, the coupler having a releasing group can be represented by the following general formula (7):

$$Cp—H \quad (6)$$

$$Cp—L \quad (7)$$

wherein Cp represents a mother nucleus of the coupler; H represents a hydrogen atom; and L represents a substituent capable of being released as a carbonium ion upon coupling with the diazonium salt (hereinafter sometimes referred to as a "releasing group").

The "coupling rate" referred to in the present invention is defined as a value that is obtained by the following measurement method in view of the constraint of the diazonium salt participating in the reaction.

An ethyl acetate solution containing the diazonium salt in $8\times10^{-5}$ M and an ethyl acetate solution containing the coupler and the base in $8\times10^{-3}$ M, respectively, are mixed in an equivalent ratio by using a stopped-flow measuring device (RA-401, produced by Otsuka Electronics Co., Ltd.). The change with the lapse of time of the absorbance of the dye thus formed is measured, and the coupling rate constant (k) is calculated from the following equation (1):

$$d[\text{dye}]/dt=k[\text{diazonium salt}] \quad \text{Equation (1)}$$

In the equation (1), k represents the coupling rate constant ($s^{-1}$), t represents the time (s), [dye] represents the produced molar amount of the dye (mol), and [diazonium salt] represents the initial molar amount of the diazonium salt (mol).

The coupler used in the process for an azo coupling reaction of the present invention has one of the structures represented by the general formulae (1), (2) and (3), and L in the general formulae (1), (2) and (3) represents a substituent capable of being released as a carbonium ion upon coupling with the diazonium salt (releasing group). Only one of the releasing group L may be introduced into the mother nucleus of the coupler as a substituent, or two or more thereof may be introduced.

(1)

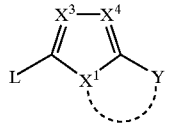

(2)

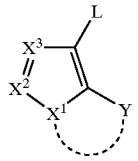

(3)

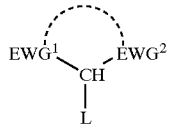

The releasing group represented by L is preferably a substituent represented by the general formula (4):

$$—CHR^1R^2 \quad (4)$$

wherein at least one of $R^1$ and $R^2$ contains an electron source capable of stabilizing a carbonium ion by resonance, i.e., a heteroatom having an unpaired electron, such as an oxygen atom and a nitrogen atom.

Preferable examples of the group represented by $R^1$ and $R^2$include a hydroxyl group, an amino group, a mercapto group, an alkoxy group, an aryloxy group, a substituted amino group, a substituted mercapto group, and an aromatic group and an ethylene group substituted by these substituents.

In the case where $R^1$ is the group having an electron source capable of stabilizing a carbonium ion by resonance, preferable examples of $R^2$ include a hydrogen atom, an alkyl group and an aryl group.

In the case where two or more of the releasing groups L are introduced as substituents, they may be the same or different, and these substituents may further have the substituents described in the foregoing.

More specifically, in the case where $R^2$ is a hydrogen atom, preferable examples of the releasing group L include a hydroxymethyl group, an aminomethyl group, a mercaptomethyl group, an alkoxymethyl group (such as a methoxymethyl group and an ethoxymethyl group), an aryloxymethyl group (such as a phenoxymethyl group and a p-toluyloxymethyl group), a substituted aminomethyl group (such as a dimethylaminomethyl group, a diarylaminomethyl group and a phenylmethylaminomethyl group), a substituted mercaptomethyl group (such as a thioethoxymethyl group and a thiophenoxymethyl group), a hydroxybenzyl group, an alkoxybenzyl group (such as a methoxybenzylmethyl group), an aminobenzyl group, a substituted aminomethyl group (such as dimethylaminobenzyl group and a diarylaminobenzyl group), a mercaptobenzyl group, a substituted mercaptobenzyl group (such as a thiomethoxybenzyl group and a thiophenoxybenzyl group) and a dimethylaminopropenyl group.

In the case where $R^1$ is a group or an atom other than hydrogen, preferable examples of the releasing group L include a releasing group represented by the following structural formulae.

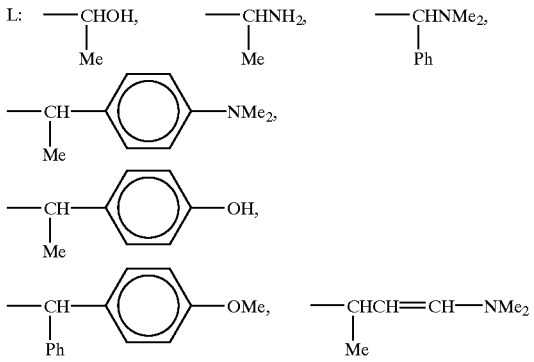

In the case where $R^1$ and $R^2$ are substituents having an electron source capable of stabilizing a carbonium ion by resonance, preferable examples of the releasing group L include a bisethoxymethyl group, a bisdimethylaminomethyl group, a bisthiomethoxymethyl group and a releasing group represented by the following structural formulae.

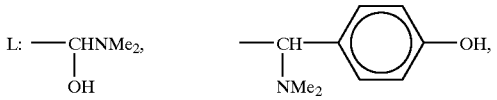

-continued

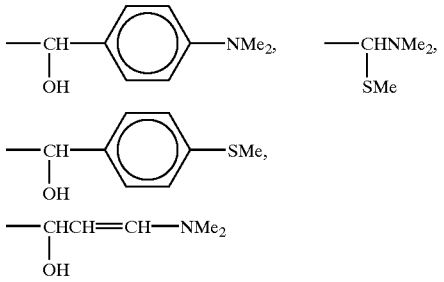

The 5-membered heterocyclic ring of the coupler having the structure represented by the general formula (1) or (2) is preferably one of a pyrrole ring, a pyrazole ring and an imidazole ring.

$EWG^1$ and $EWG^2$ of the coupler having the structure represented by the general formula (3) each independently represents an electron drawing group, provided that $EWG^1$ and $EWG^2$ may be combined to form a heterocyclic ring, and $EWG^1$ and $EWG^2$ each is preferably a carbonyl group.

Specific examples of compounds that are preferably used as the coupler in the present invention include the following compounds (C-1) to (C-33), but the present invention is not limited to these compounds. The compounds (C-1) to (C-18) are examples of the compound having the structure represented by the general formula (1), the compounds (C-19) to (C-26) are examples of the compound having the structure represented by the general formula (2), and the compounds (C-27) to (C-33) are examples of the compound having the structure represented by the general formula (3).

(C-1)

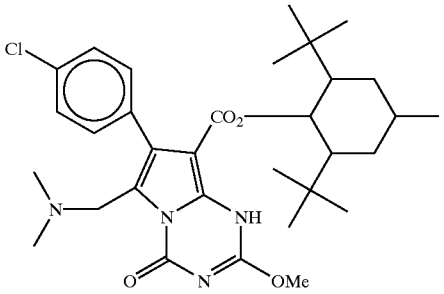

(C-2)

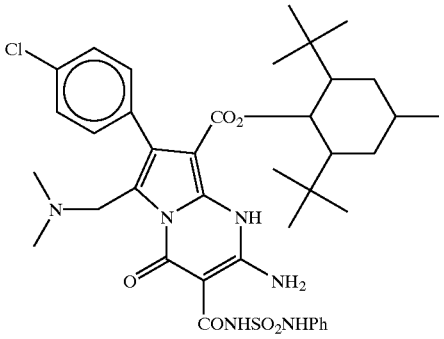

-continued
(C-3)
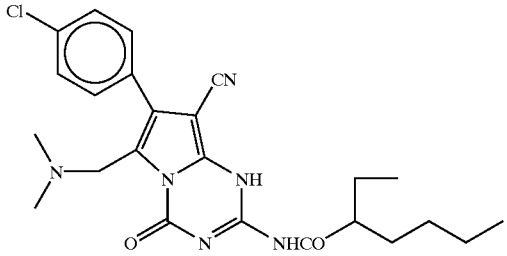
(C-4)
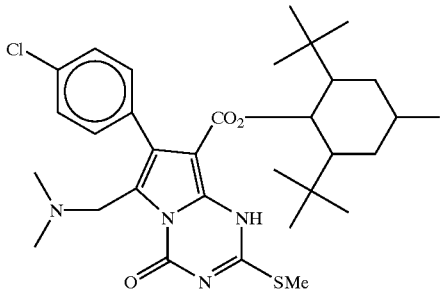
(C-5)
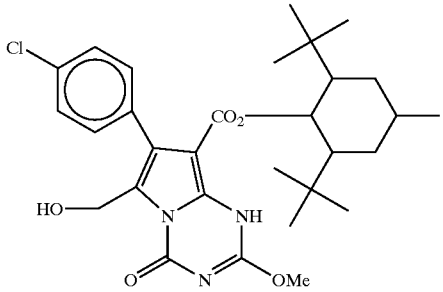
(C-6)
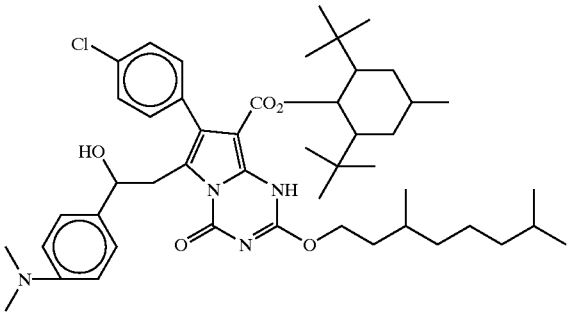
(C-7)
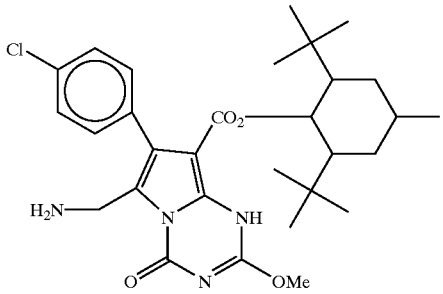
-continued
(C-8)
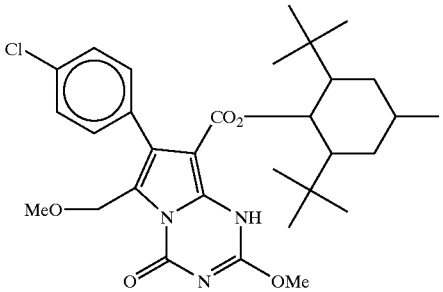
(C-9)
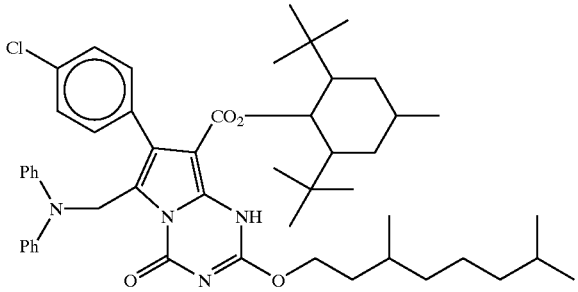
(C-10)
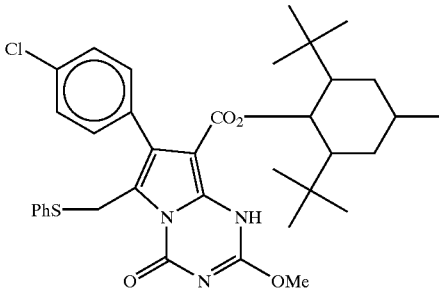
(C-11)
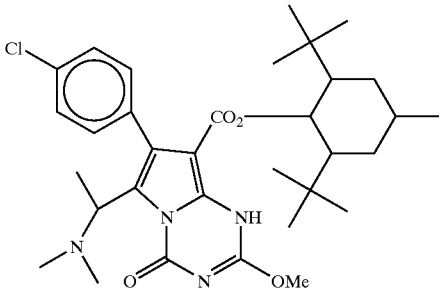
(C-12)
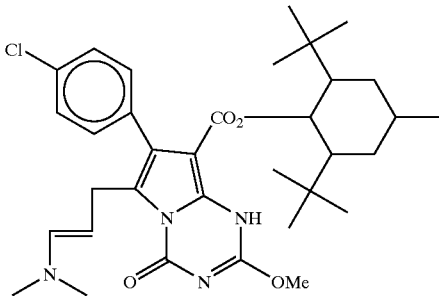

-continued
(C-13)
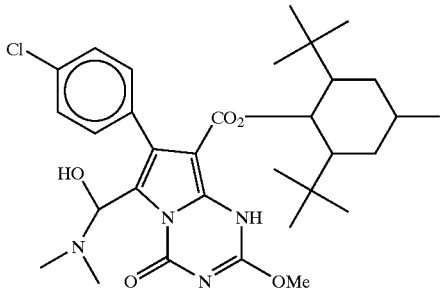
(C-14)
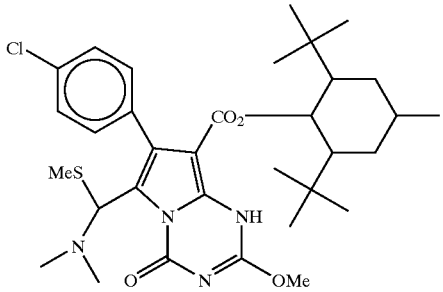
(C-15)
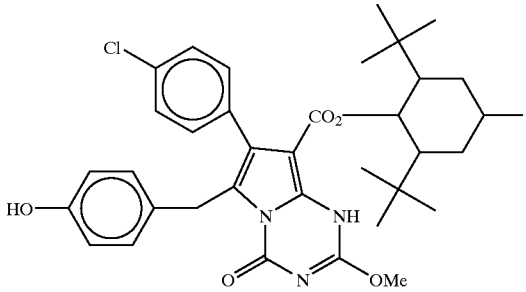
(C-16)
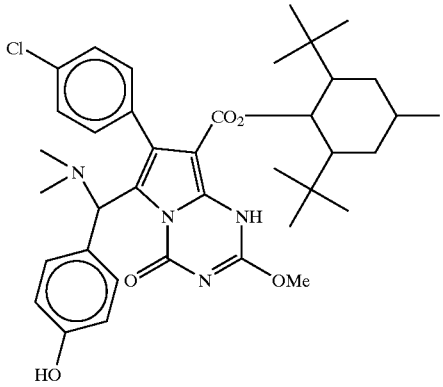
(C-17)
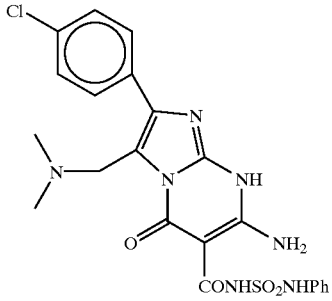
-continued
(C-18)
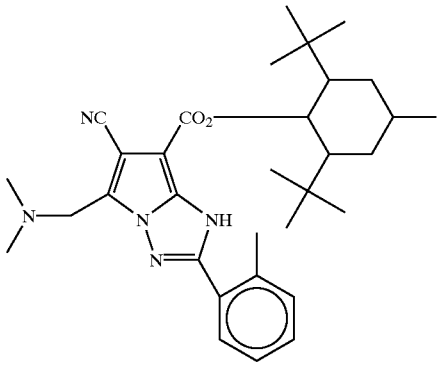
(C-19)
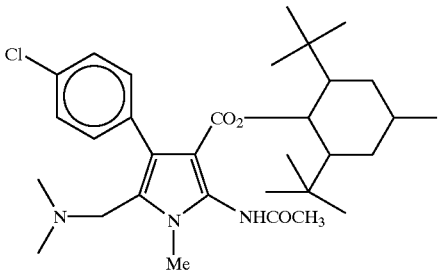
(C-20)
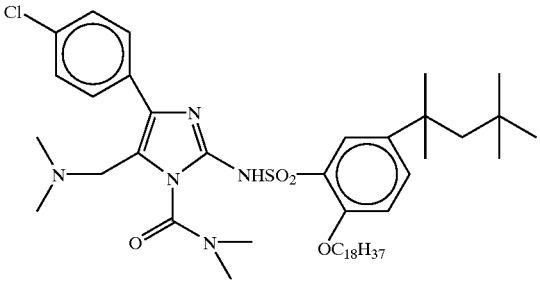
(C-21)
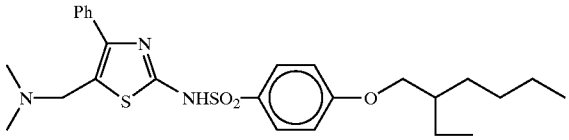
(C-22)
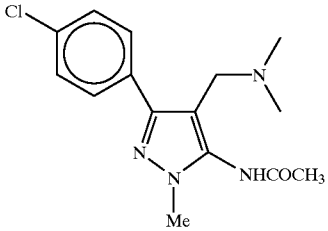
(C-23)
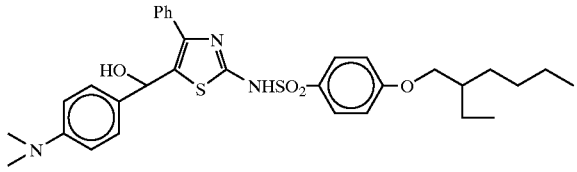

-continued (C-24)

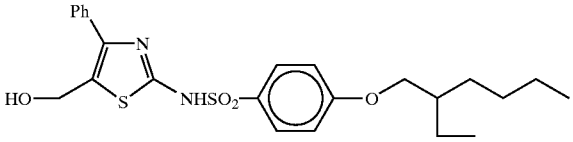

(C-25)

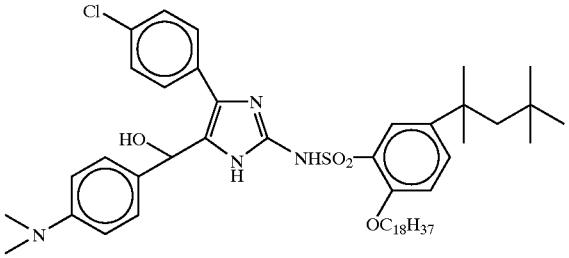

(C-26)

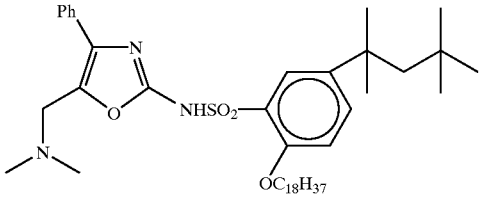

(C-27)

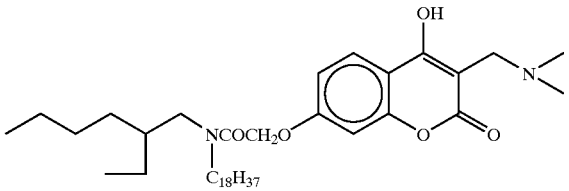

(C-28)

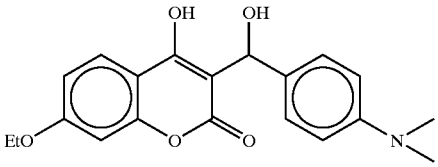

(C-29)

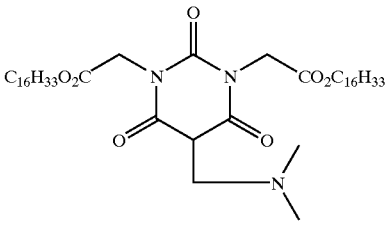

(C-30)

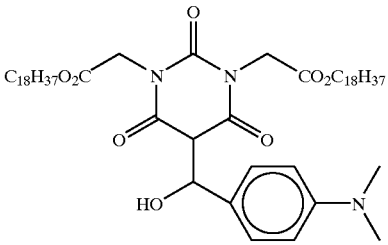

-continued (C-31)

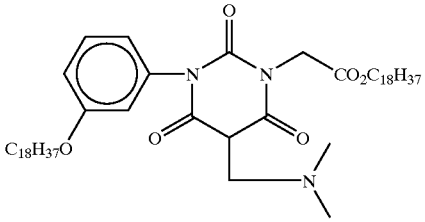

(C-32)

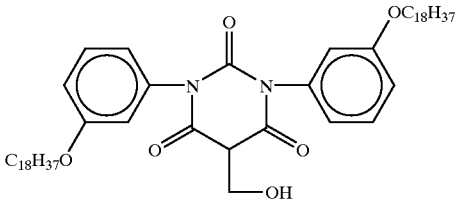

(C-33)

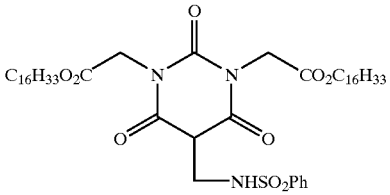

The coupler compound having a releasing group that can be used in the invention can be synthesized by various methods, and in general, a corresponding coupler (having no substituent at the coupling site) is reacted with a suitable reagent. For example, a hydroxymethyl releasing group can be synthesized in such a manner that a formyl group is introduced by using a Vilsmeier reagent, and then the formyl group is reduced. A dimethylaminomethyl releasing group can be synthesized by reacting with a Mannich reagent. Various kinds of substituted hydroxymethyl groups can be synthesized by adding an aldehyde to the coupler.

Diazonium Salt

The diazonium salt that colors through reaction with the coupler in the process for azo coupling reaction of the invention is not particularly limited, and a diazonium salt compound represented by the following general formula (A) can be used through arbitrary selection. The diazonium salt is a compound that is colored through a coupling reaction with the coupler under application of heat and is decomposed by light.

$$Ar—N2^+X^- \quad (A)$$

wherein Ar represents an aromatic part, and $X^-$ represents an acid anion.

The diazonium salt is preferably a benzene diazonium salt represented by the general formula (5):

(5)

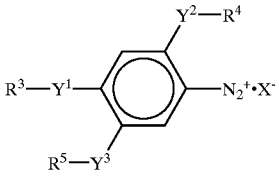

wherein $R^3$, $R^4$ and $R^5$, which may be the same or different, each independently represents an alkyl group, an aryl group, an aralkyl group, an alkenyl group, a heterocyclic group or an acyl group; $Y^1$ represents an oxygen atom, a sulfur atom or an amino group; $Y^2$ represents an oxygen atom or a sulfur atom; $Y^3$ represents an oxygen atom, a sulfur atom or a hydrogen atom, provided that when $Y^3$ represents a hydrogen atom, $R^5$ is not present; and $X^-$ represents an anion.

$Y^1$ preferably represents a sulfur atom or an amino group, and in the case where $Y^1$ is an amino group, it may have a substituent. Examples of the substituent include an alkyl group, an aryl group and an aralkyl group. $Y^1$ and $R^3$ may form a ring. Examples of the ring include a pyrrolidinyl group, a piperidinyl group and a piperazinyl group, which may have a substituent.

It is more preferable that $Y^1$ is a sulfur atom, and $Y^2$ and $Y^3$ are oxygen atoms.

In the case where $R^3$, $R^4$ and $R^5$ are alkyl groups, an alkyl group having from 1 to 30 carbon atoms is preferable, which may be either linear, branched or cyclic and may have a substituent. Examples of the substituent include an alkoxy group, an aryloxy group, a halogen atom, an alkylamino group, an arylamino group, an amino group, a carbamoyl group, a hydroxyl group, an acyloxy group, an alkoxycarbonyl group and an acylamino group. The substituent may further have a substituent. Examples of the substituted or unsubstituted alkyl group include a methyl group, an ethyl group, a propyl group, a butyl group, a pentyl group, a sec-pentyl group, a methoxyethyl group, an ethoxyethyl group and an acetoxyethyl group.

In the case where $R^3$, $R^4$ and $R^5$ are aryl groups, an aryl group having from 6 to 30 carbon atoms is preferable, examples of which include a phenyl group and a naphthyl group. The aryl group may have a substituent, and examples of the substituent include an alkoxy group, an aryloxy group, a halogen atom, an alkylamino group, an arylamino group, an amino group, a carbamoyl group, a hydroxyl group, an acyloxy group, an alkoxycarbonyl group and an acylamino group. The substituent may further have a substituent.

In the case where $R^3$, $R^4$ and $R^5$ are aralkyl groups, an aralkyl group having from 7 to 30 carbon atoms is preferable, examples of which include a benzyl group and a phenethyl group. The aralkyl group may have a substituent, and examples of the substituent include an alkoxy group, an aryloxy group, a halogen atom, an alkylamino group, an arylamino group, an amino group, a carbamoyl group, a hydroxyl group, an acyloxy group, an alkoxycarbonyl group and an acylamino group.

In the case where $R^3$, $R^4$ and $R^5$ are alkenyl groups, an alkenyl group having from 2 to 20 carbon atoms is preferable, examples of which include a 4-pentenyl group, a 5-hexenyl group, a 3-methyl-3-butenyl group and a crotyl group. The alkenyl group may have a substituent, and examples of the substituent include an aryl group, an alkoxy group, an aryloxy group, a halogen atom, an alkylamino group, an arylamino group, an amino group, a carbamoyl group, a hydroxyl group, an acyloxy group, an alkoxycarbonyl group and an acylamino group.

In the case where $R^3$, $R^4$ and $R^5$ are heterocyclic groups, a heterocyclic group having nitrogen, oxygen and/or sulfur as a heteroatom is preferable, which may be either saturated, unsaturated, monocyclic or condensed ring, examples of which include furyl, thienyl, oxazolyl, thiazolyl, imidazolyl, pyrazolyl, pyridyl, pyrimidyl, piperidyl, piperidyno, morpholinyl, morpholino, piperazinyl, indolyl, isoindolyl and quinolyl. The heterocyclic group may have a substituent, and examples of the substituent include an alkyl group, an aryl group, an alkoxy group, an aryloxy group, a halogen atom, an alkylamino group, an arylamino group, an amino group, a hydroxyl group, an acyl group, an acyloxy group, an alkoxycarbonyl group and an acylamino group.

In the case where $R^3$, $R^4$ and $R^5$ are acyl groups, an acyl group having from 2 to 20 carbon atoms is preferable, which may be either aliphatic, aromatic or heterocyclic, examples of which include an acetyl group, a propanoyl group, a butanoyl group, a hexanoyl group, a 2-ethylhexanoyl group and a benzoyl group. The acyl group may have a substituent, and examples of the substituent include an alkoxy group, an aryloxy group, a halogen atom, an alkylamino group, an arylamino group, an amino group, a hydroxyl group, an acyloxy group, an alkoxycarbonyl group and an acylamino group.

Among these, $R^3$ is preferably a substituted aryl group having from 6 to 20 carbon atoms, and a 4-chlorophenyl group, a 2-N-substituted carbamoylphenyl group, a 4-N-substituted carbamoylphenyl group, a 3-tolyl group, a 4-tolyl group and a 2,5-dichlorophenyl group are more preferable.

$R^4$ and $R^5$ each is preferably an alkyl group having from 1 to 20 carbon atoms or an alkenyl group having from 3 to 20 carbon atoms.

Examples of the acid anion ($X^-$) include a perfluoroalkyl carboxylic acid having from 1 to 20 carbon atoms (such as perfluorooctanoic, perfluorodecanoic acid and perfluorododecanoic acid), a perfluoroalkylsulfonic acid having from 1 to 20 carbon atoms (such as perfluorooctanesulfonic acid, perfluorodecanesulfonic acid and perfluorohexadecanesulfonic acid), an aromatic carboxylic acid having from 7 to 50 carbon atoms (such as 4,4-di-t-butylsalicylic acid, 4-t-octyloxybenzoic acid, 2-n-octyloxybenzoic acid, 4-n-hexadecylbenzoic acid, 2,4-bis-n-octadecyloxybenzoic acid and 4-n-decylnaphthoic acid), an aromatic sulfonic acid having from 6 to 50 carbon atoms (such as 1,5-naphthalenedisulfonic acid, 4-t-octyloxybenzenesulfonic acid and 4-n-dodecylbenzenesulfonic acid), 4,5-di-t-butyl-2-naphthoic acid, tetrafluoroboric acid, tetraphenylboric acid and hexafluorophosphoric acid. Among these, a perfluoroalkylcarboxylic acid having from 6 to 16 carbon atoms, a perfluoroalkylsulfonic acid having from 6 to 16 carbon atoms, an aromatic carboxylic acid having from 10 to 40 carbon atoms, an aromatic sulfonic acid having from 10 to 40 carbon atoms, tetrafluoroboric acid, tetraphenylboric acid and hexafluorophosphoric acid are preferable.

The reason why these diazonium salts are preferably used is that these exert a large effect to increase the reaction rate owing to the introduction of the releasing group.

Specific examples of the diazonium salt used in the invention include the following compounds (D-1) to (D-39), but the present invention is not limited to these compounds.

D-1

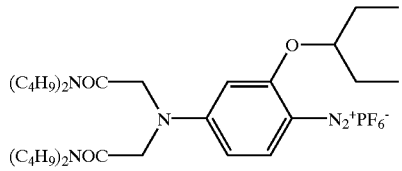

D-2

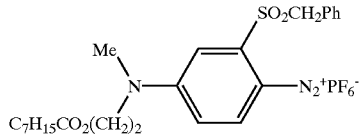

-continued
D-3
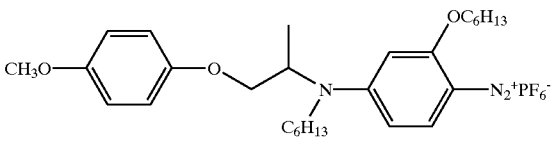
D-4
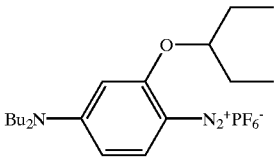
D-5
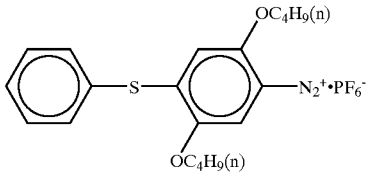
D-6
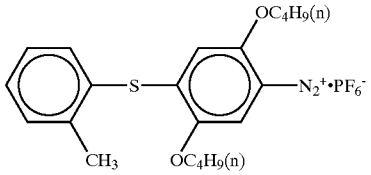
D-7
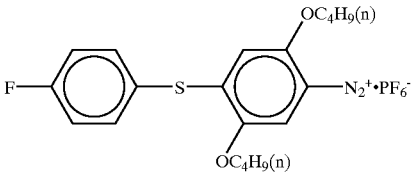
D-8
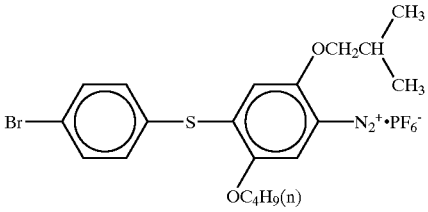
D-9
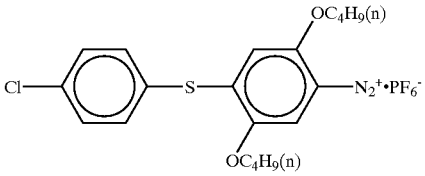
D-10
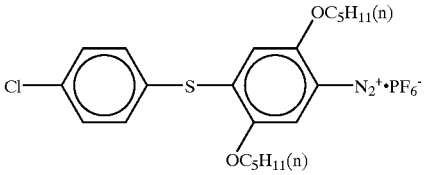
-continued
D-11
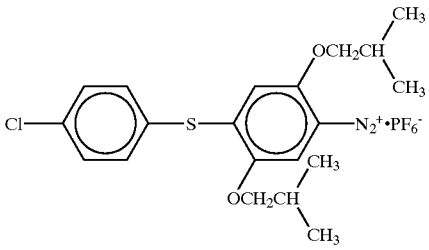
D-12
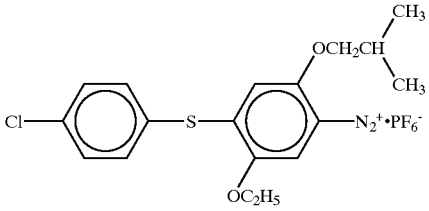
D-13
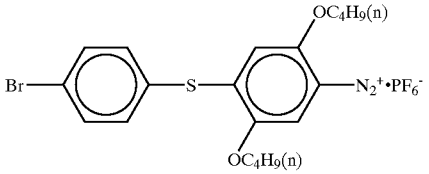
D-14
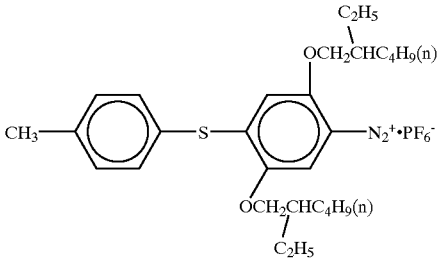
D-15
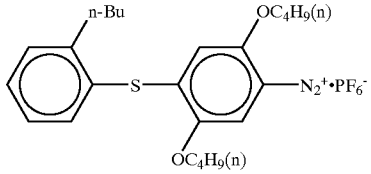
D-16
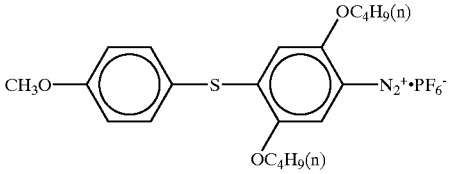
D-17
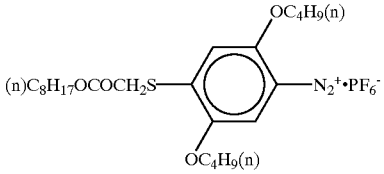

-continued
D-18
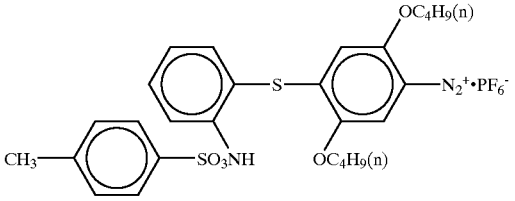
D-19
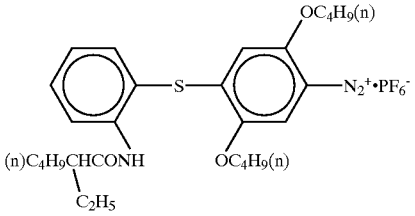
D-20
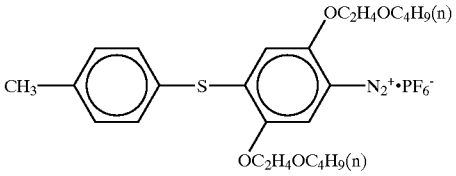
D-21
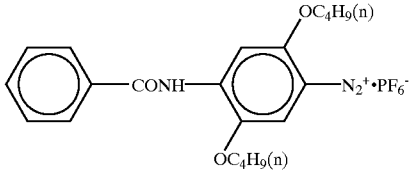
D-22
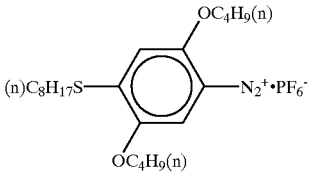
D-23
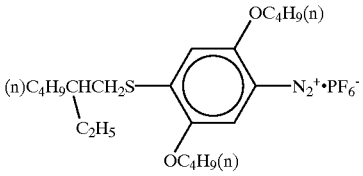
D-24
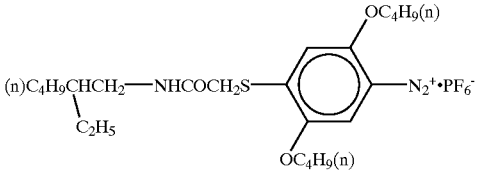
D-25
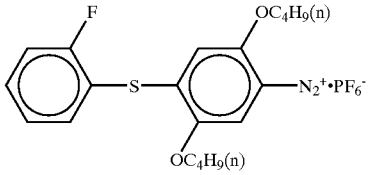
-continued
D-26
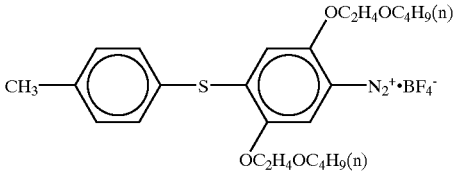
D-27
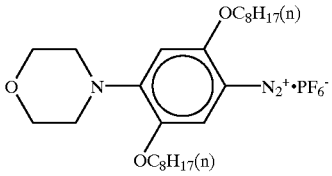
D-28
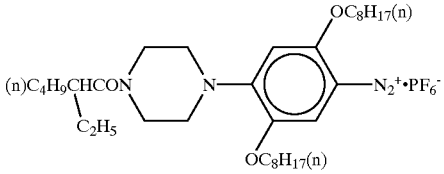
D-29
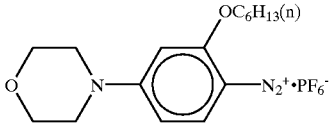
D-30
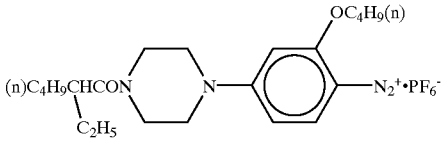
D-31
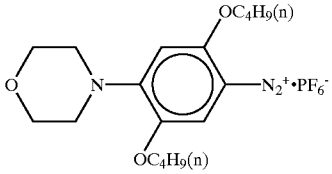
D-32
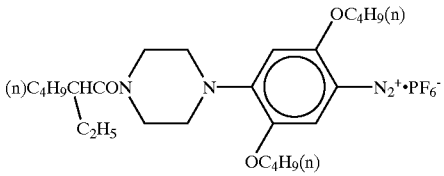
D-33
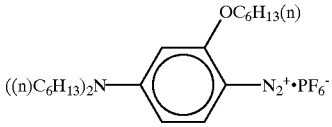
D-34
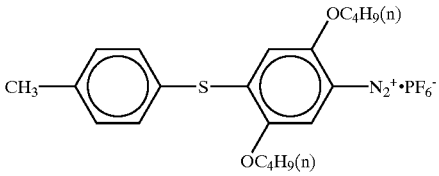

-continued

D-35

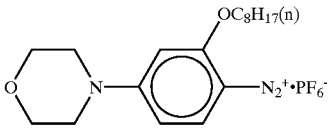

D-36

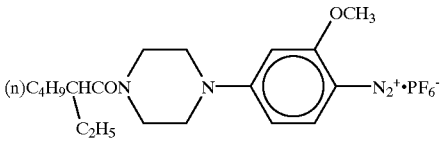

D-37

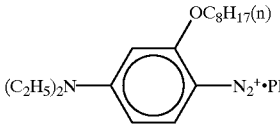

D-38

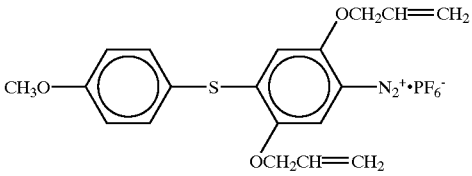

D-39

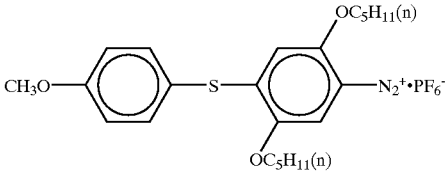

In the process for an azo coupling reaction of the present invention, the amount ratio of the coupler and the diazonium salt can be appropriately selected depending on the compounds used, and the coupler is preferably used in an amount of from 1.0 to 10.0 parts by mass, and more preferably from 1.0 to 2.0 parts by mass, per 1 part by mass of the diazonium salt. When it is less than 1.0 part by mass, sufficient color formation cannot be obtained, and when it exceeds 10.0 parts by mass, no further increase of the effect is obtained.

In the process for an azo coupling reaction of the present invention, a sufficient reaction rate is obtained by the coupler having a releasing group, and the effect is outstanding when the coupler represented by the general formulae (1) to (3) and the diazonium salt compound represented by the general formula (5) are used.

In the process for an azo coupling reaction of the present invention, an organic base may be used for accelerating the coupling reaction. Examples of the base used include a guanidine compound, a tertiary amine compound, a pyridine compound, a piperidine compound, an amidine compound, a formamidine compound and a morpholine compound. Among these, a guanidine compound and a tertiary amine compound are preferable. Furthermore, the organic bases described in JP-A-57-123086, JP-A-60-49991, JP-A-60-94381, JP-A-9-71048, JP-A-9-77729 and JP-A-9-77737 may also be used.

Specific examples of the organic base that is preferably used in the process for an azo coupling reaction of the present invention include the following compounds (B-1) to (B-8), but the present invention is not limited to these compounds.

(B-1)

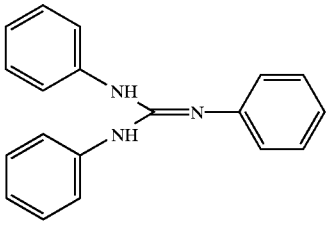

(B-2)

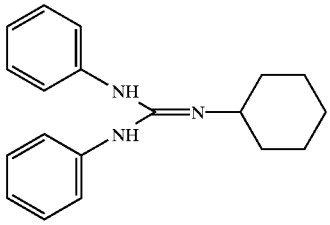

(B-3)

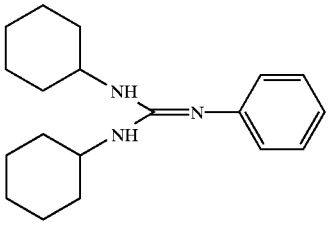

(B-4)

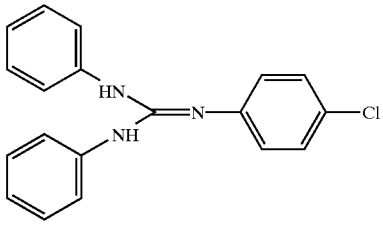

(B-5)

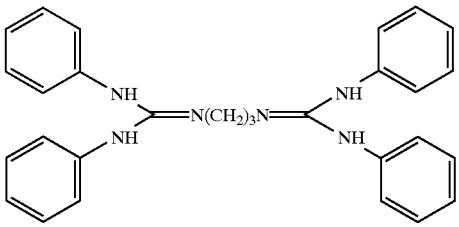

-continued (B-6)

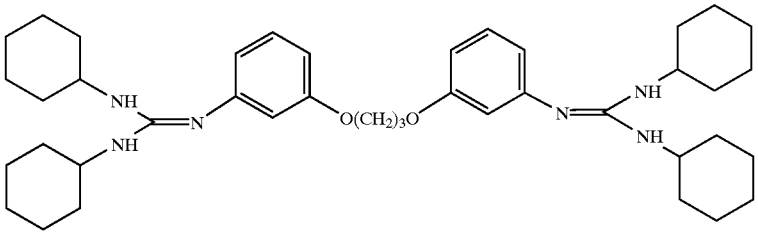

(B-7) (B-8)

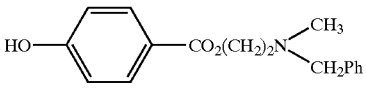

$(n\text{-}C_8H_{17})_3N$ (B-6)

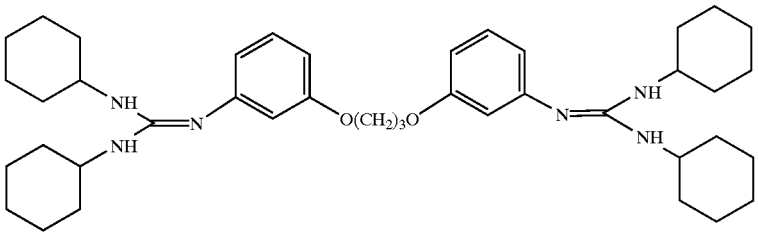

(B-7)

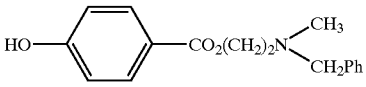

(B-8)

$(n\text{-}C_8H_{17})_3N$

The amount of the organic base used is not particularly limited, and it is preferable to use in an amount of from 1 to 30 mol per 1 mol of the diazonium salt.

Recording Material

The recording material of the present invention utilizing the azo coupling reaction and having excellent stability and a high coloring rate will be described below.

The recording material of the present invention comprises a coupler having one of the structures represented by the general formulae (1), (2) and (3), and a diazonium salt capable of coloring through a coupling reaction with the coupler.

(1)

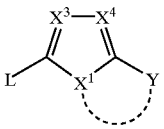

(2)

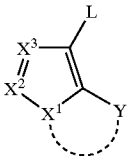

(3)

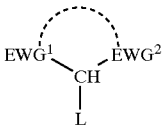

wherein $X^1$, $X^2$, $X^3$ and $X^4$ each independently represents an atomic group necessary for forming a 5-membered aromatic heterocyclic ring; Y represents an amino group, a substituted amino group, a hydroxyl group, an alkoxy group, an alkyl group, which may have a substituent, provided that $X^1$ and Y may be combined to form a heterocyclic ring; L represents a substituent capable of being released as a carbonium ion upon coupling with the diazonium salt; and $EWG^1$ and $EWG^2$each independently represents an electron withdrawing group, provided that $EWG^1$ and $EWG^2$ may be combined to form a heterocyclic ring.

The coupler and the diazonium salt contained in the recording material are the same as those described for the process for an azo coupling reaction, and preferable examples thereof are also the same.

The recording material of the present invention may be either a heat-sensitive recording material or a diazo photosensitive recording material as long as it utilizes an azo coupling reaction for color formation. Because it is particularly excellent in coloring rate and stability, the effect thereof is outstanding when it is applied to a heat-sensitive recording material capable of carrying out imagewise recording with a thermal head or laser.

A heat-sensitive recording material will be described below as an example of the recording material of the present invention.

The diazonium salt used in the recording material of the present invention is a compound that is colored through a coupling reaction with the coupler under application of heat and is decomposed by light. The maximum absorption wavelength thereof can be controlled by the position and the species of the substituent at the portion of Ar in the general formula (A).

The diazonium salt used in the recording material of the present invention preferably contains 12 or more carbon atoms and preferably has a solubility in water of 1% or less and a solubility in ethyl acetate of 5% or more.

The diazonium compound may be used singly or in combination of two or more kinds thereof in accordance with various purposes such as hue adjustment.

The diazonium salt is preferably used in a recording layer of the recording material in an amount of from 0.01 to 3 $g/m^2$, and more preferably from 0.02 to 1.0 $g/m^2$. When the amount is less than 0.01 $g/m^2$, sufficient color formation cannot be obtained, and when it exceeds 3 $g/m^2$, it is not preferable since the sensitivity is lowered, and the fixing time is necessarily prolonged.

In the case where the diazonium salt used in the recording material of the present invention is used in the heat-sensitive recording material, it is preferable that the diazonium salt is encapsulated in microcapsules to improve the storage stability before use.

The production of the microcapsules can be attained by the known processes.

Examples thereof include interface polymerization processes described in U.S. Pat. No. 3,287,154, British Patent No. 990,443, JP-B-38-19574, JP-B-42-446 and JP-B-42-771, a process using an isocyanate polyol wall material described in U.S. Pat. No. 3,914,511, a process using an isocyanate wall material described in U.S. Pat. No. 3,914,511, and an in situ process by polymerization of a monomer described in JP-B-36-9168 and JP-A-51-9079.

The process for encapsulating in microcapsules is not limited to these processes. In a photosensitive heat-sensitive transfer material, an interface polymerization process is particularly preferable. In this process, an oily phase is formed by dissolving or dispersing a coloring component in a hydrophobic organic solvent to be a core of the capsule, and an aqueous phase is formed by dissolving a water soluble polymer. The oily phase and the aqueous phase are mixed and dispersed for emulsification, for example, by a homogenizer, and then the mixture is heated to conduct a polymer formation reaction at the interface of oil droplets, so as to form a microcapsule wall composed of the polymer.

Consequently, capsules having a uniform particle diameter can be formed in a short period of time to produce a recording material excellent in storage stability before use. The process for forming microcapsules is described in detail, for example, in JP-A-2-141279.

The coupler compound forms a dye through coupling with the diazonium compound in a basic atmosphere and/or a neutral atmosphere, and can be used by combining plural kinds thereof for various purposes, such as hue adjustment.

The coupler compound can be added to the recording layer in an amount of from 0.02 to 5 $g/m^2$, and is more preferably added in an amount of from 0.1 to 4 $g/m^2$ from the standpoint of the effect. When the added amount is less than 0.02 $g/m^2$, it is not preferable since the color formation is poor, and when it exceeds 5 $g/m^2$, it is also not preferable since the coating property is deteriorated.

The coupler compound is used in combination with the diazonium salt.

In this case, the coupler compound is preferably used in an amount of from 0.5 to 20 parts by mass, and more preferably from 1 to 10 parts by mass, per 1 part by mass of the diazonium salt. When it is less than 0.5 part by mass, sufficient color formation cannot be obtained, and when it exceeds 20 parts by mass, it is not preferable since the coating property is deteriorated.

While the coupler compound can be used through solid dispersion, for example, by a sand mill, after adding a water soluble polymer along with other component, it is preferable that the coupler is emulsified with a suitable emulsification assistant to be used as an emulsion. The methods for solid dispersion and emulsification herein are not particularly limited, and those known in the conventional art can be employed. The methods are described in detail in JP-A-59-190886, JP-A-2-141279 and JP-A-7-17145.

In the recording material of the present invention, it is also preferable to use an organic base in combination as described for the process for azo coupling reaction. In the case where the base is used in combination, it is preferable that the organic base is added to the emulsion dispersion of the coupler and mixed.

The recording material of the present invention may comprise a known support having formed thereon a recording layer containing the coupler and the diazonium salt. As long as the effects of the present invention are not compromised, known additives used in recording materials may be used in combination, and other layers, such as an undercoating layer, a protective layer and an ultraviolet ray absorbing layer, may be provided in addition to the support and the recording layer.

The present invention will be described in more detail with reference to the following examples, but the present invention is not limited thereto.

EXAMPLES

Example 1

Measurement of Coupling Rate

A coupling reaction constant was calculated by using the coupler (C-1), the diazonium salt (D-1) and the base (TPG (triphenylguanidine) (B-1)) according to the present invention. The results are shown in Table 1.

(Coupler (C-1))

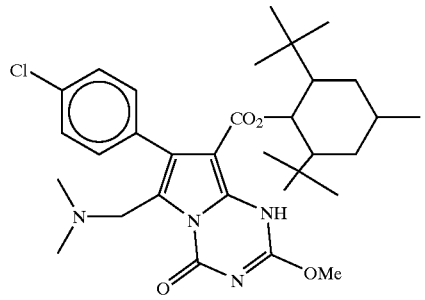

(Diazonium Salt (D-1))

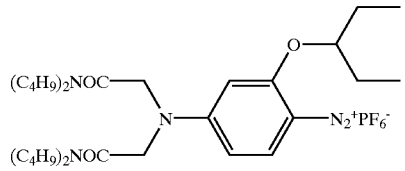

An ethyl acetate solution containing the diazonium salt in 8×10−5 M and an ethyl acetate solution containing the coupler and the base in 8×10−3 M, respectively, were mixed in an equivalent ratio by using a stopped-flow measuring device (RA-401, produced by Otsuka Electronics Co., Ltd.). The change with the lapse of time of the absorbance of the dye thus formed was measured, and the coupling rate constant (k) was calculated from the following equation (1):

$$d[\text{dye}]/dt = k[\text{diazonium salt}] \qquad \text{Equation (1)}$$

In the equation (1), k represents the coupling rate constant ($s^{-}$), t represent the time (s), [dye] represents the produced molar amount of the dye (mol), and [diazonium salt] represents the initial molar amount of the diazonium salt (mol).

Examples 2 to 13 and Comparative Examples 1 to 4

Azo coupling reactions were carried out by using the combinations of the couplers, the diazonium salts and the bases shown in Table 1 instead of those used in Example 1, and the coupling rate constants were calculated in the same manner as in Example 1. The results are shown in Table 1.

In Table 1, the couplers (C-1') to (C-29') are such couplers that have the same mother nuclei as the example coupler compounds (C-1) to (C-34) but the releasing groups L are replaced by H.

TABLE 1

| | Coupler | Diazonium Salt | Base | Coupling Rate |
|---|---|---|---|---|
| Example 1 | C-1 | D-1 | B-1 | 0.72 |
| Example 2 | C-2 | D-1 | B-1 | 0.69 |
| Example 3 | C-5 | D-1 | B-1 | 0.31 |
| Example 4 | C-6 | D-1 | B-1 | 1.01 |
| Example 5 | C-18 | D-1 | B-1 | 1.02 |
| Example 6 | C-20 | D-1 | B-1 | 0.23 |
| Example 7 | C-21 | D-1 | B-1 | 0.19 |
| Example 8 | C-27 | D-1 | B-1 | 0.59 |
| Example 9 | C-29 | D-1 | B-1 | 0.61 |
| Example 10 | C-31 | D-1 | B-1 | 0.52 |
| Example 11 | C-1 | D-2 | B-1 | 0.81 |
| Example 12 | C-2 | D-2 | B-1 | 0.71 |
| Example 13 | C-1 | D-3 | B-1 | 0.69 |
| Comparative Example 1 | C-1' | D-1 | B-1 | 0.02 |
| Comparative Example 2 | C-2' | D-1 | B-1 | 0.012 |
| Comparative Example 3 | C-27' | D-1 | B-1 | 0.10 |
| Comparative Example 4 | C-29' | D-1 | B-1 | 0.20 |

It is understood from the results shown in Table 1 that the azo coupling reaction of the present invention is excellent in coupling rate in comparison to the conventional couplers having the same mother nuclei.

Example 14

Heat-Sensitive Recording Material

Preparation of Microcapsule Liquid A 2.8 parts of the diazonium salt (D-1) (maximum absorption wavelength: 370 nm) and 10 parts of tricresyl phosphate were added to 19 pats of ethyl acetate and uniformly mixed. 7.6 parts of Takenate D-110N (produced by Takeda Chemical Industries, Ltd.) as a wall material was added to the resulting mixture and uniformly mixed to obtain Liquid I.

46 parts of an 8% by mass aqueous solution of phthalated gelatin, 17.5 parts of water and 2 parts of a 10% aqueous solution of sodium dodecylbenzenesulfonate were added to the Liquid I and dispersed and emulsified at 40° C. and 10,000 rpm for 10 minutes. 20 parts of water were added to the resulting emulsion, followed by homogenizing, and a microcapsulation reaction was carried out at 40° C. for 3 hours under stirring to obtain Microcapsule Liquid A. The microcapsules had an average particle diameter of from 0.7 to 0.8 $\mu$m.

Preparation of Coupler Emulsion B 3.0 parts of the coupler (C-1), 3.0 parts of triphenylguanidine (base (B-1)), 0.5 part of tricresyl phosphate and 0.24 part of diethyl maleate were added and dissolved in 10.5 parts of ethyl acetate to obtain Liquid II.

The Liquid II was added to a mixture formed by uniformly mixing at 40° C. 49 parts of 15% by mass aqueous solution of lime-treated gelatin, 9.5 parts of a 10% aqueous solution of sodium dodecylbenzenesulphonate and 35 parts of water, and the resulting mixture was dispersed and emulsified at 40° C. and 10,000 rpm for 10 minutes. Ethyl acetate was removed from the resulting emulsion by stirring the emulsion at 40° C. for 2 hours, and then water was added thereto in an amount corresponding to the weight of the ethyl acetate and water having been evaporated, so as to obtain Coupler Emulsion B.

Preparation of Heat-sensitive Recording Layer Coating Composition C 3.6 parts of the Microcapsule Liquid A, 3.3 parts of water and 9.5 parts of the Coupler Emulsion B were uniformly mixed to obtain Heat-Sensitive Recording Layer Coating Composition C.

Preparation of Protective Layer Coating Composition D 100 parts of a 6% aqueous solution of itaconic acid-modified polyvinyl alcohol (KL-318, a trade name, produced by Kuraray Co., Ltd.) and 10 parts of a 30% dispersion of epoxy-modified polyamide (FL-71, a trade name, produced by Toho Chemical Industry Co., Ltd.) were mixed to form a mixture, to which 15 parts of a 40% dispersion of zinc stearate (Hydrin Z, a trade name, produced by Chukyo Yushi Co., Ltd.) was uniformly mixed to obtain Protective Layer Coating Composition D.

Coating

The Heat-Sensitive Recording Layer Coating Composition C and the Protective Layer Coating Composition D were coated in this order and dried at 50° C. on a support for photographic paper formed by laminating high quality paper with polyethylene, so as to obtain an objective heat-sensitive recording material. The coating amounts were 8.0 g/m$^2$ and 1.2 g/m$^2$, respectively, in terms of solid content.

The heat-sensitive recording material was evaluated in the following standards. The results obtained are shown in Table 2.

Color Formation Test

Thermal printing of the recording material was carried out by using a thermal head (Type KST, produced by Kyocera Corp.) in such a manner that the application voltage and the pulse width were determined to obtain recording energy per unit area of 50 mJ/mm$^2$. The whole surface of the recording material was then irradiated by using an ultraviolet ray lamp of an emission center wavelength of 365 nm and an output power of 40W for 15 seconds. The densities of the image part and the background part of the resulting sample were measured with a Macbeth densitometer.

Evaluation of Hue

The image part colored by using a thermal head (Type KST, produced by Kyocera Corp.) was measured for a reflection spectrum by using an UV/VIS spectroscope, which was normalized with the maximum absorbance as 1.0. The results obtained mean that as the absorbance within a wavelength range of from 400 to 475 nm is smaller, better cyan hue with less yellowish tone is obtained.

Image Light Resistance Test

The image part colored by using a thermal head (Type KST, produced by Kyocera Corp.) was irradiated continuously for 72 hours at 32,000 lux by using a fluorescent lamp light resistance testing machine, and then the density of the image part was measured. The higher the density of the image part after the light irradiation was, the better the image light resistance become.

Image Fixing Property Test

The test for image fixing property was carried out in such a manner that the background part (non-printed part) of the fixed sample obtained in the foregoing was subjected to thermal printing by using a thermal head (Type KST, produced by Kyocera Corp.) in such a manner that the application voltage and the pulse width were determined to obtain recording energy per unit area of 40 mJ/mm$^2$, and the change in density was measured. The lower the density after printing was, the better the image fixing property become.

Example 15

A heat-sensitive recording material was produced and evaluated in the same manner as in Example 14 except that the emulsion was obtained by using the coupler (C-2) instead of the coupler (C-1) used in Example 14.

Example 16

A heat-sensitive recording material was produced and evaluated in the same manner as in Example 14 except that the emulsion was obtained by using the coupler (C-5) instead of the coupler (C-1) used in Example 14.

Example 17

A heat-sensitive recording material was produced and evaluated in the same manner as in Example 14 except that the emulsion was obtained by using the coupler (C-6) instead of the coupler (C-1) used in Example 14.

Example 18

A heat-sensitive recording material was produced and evaluated in the same manner as in Example 14 except that the emulsion was obtained by using the coupler (C-21) instead of the coupler (C-1) used in Example 14.

Example 19

A heat-sensitive recording material was produced and evaluated in the same manner as in Example 14 except that the emulsion was obtained by using the coupler (C-27) instead of the coupler (C-1) used in Example 14.

Example 20

A heat-sensitive recording material was produced and evaluated in the same manner as in Example 14 except that the emulsion was obtained by using the coupler (C-29) instead of the coupler (C-1) used in Example 14.

Example 21

A heat-sensitive recording material was produced and evaluated in the same manner as in Example 14 except that the emulsion was obtained by using the base (B-7) instead of the base (B-1) used in Example 14.

Example 22

A heat-sensitive recording material was produced and evaluated in the same manner as in Example 14 except that the emulsion was obtained by using the diazonium salt (D-2) instead of the diazonium salt (D-1) used in Example 14.

Comparative Example 5

A heat-sensitive recording material was produced and evaluated in the same manner as in Example 14 except that the emulsion was obtained by using the coupler (C-1') instead of the coupler (C-1) used in Example 14.

Comparative Example 6

A heat-sensitive recording material was produced and evaluated in the same manner as in Example 14 except that the emulsion was obtained by using the coupler (C-2') instead of the coupler (C-1) used in Example 14.

Comparative Example 7

A heat-sensitive recording material was produced and evaluated in the same manner as in Example 14 except that the emulsion was obtained by using the coupler (C-29') instead of the coupler (C-1) used in Example 14.

The λmax of the image part and the results of the image light resistance test and the image fixing property test of the recording materials obtained in Examples 14 to 22 and Comparative Examples 5 to 7 are shown in Table 2.

TABLE 2

| | Color Formation | Image Light Resistance Density of Image Part | | Image Fixing Property Density of Background Part | | |
|---|---|---|---|---|---|---|
| | of Image Part λ max (nm) | Before Irradiation | After Irradiation | Before Printing | After Printing | Hue |
| Example 14 | 662 | 1.87 | 1.63 | 0.07 | 0.10 | Cyan |
| Example 15 | 660 | 1.79 | 1.59 | 0.06 | 0.11 | Cyan |
| Example 16 | 662 | 1.75 | 1.53 | 0.08 | 0.12 | Cyan |
| Example 17 | 662 | 1.82 | 1.60 | 0.07 | 0.12 | Cyan |
| Example 18 | 550 | 1.78 | 1.59 | 0.07 | 0.10 | Magenta |
| Example 19 | 540 | 1.79 | 1.59 | 0.06 | 0.10 | Magenta |
| Example 20 | 541 | 1.85 | 1.65 | 0.05 | 0.10 | Magenta |
| Example 21 | 661 | 1.70 | 1.55 | 0.07 | 0.10 | Cyan |
| Example 22 | 662 | 1.82 | 1.65 | 0.06 | 0.12 | Cyan |
| Comparative Example 5 | 662 | 1.52 | 1.30 | 0.07 | 0.11 | Cyan |

TABLE 2-continued

| | Color Formation | Image Light Resistance Density of Image Part | | Image Fixing Property Density of Background Part | | |
|---|---|---|---|---|---|---|
| | of Image Part λ max (nm) | Before Irradiation | After Irradiation | Before Printing | After Printing | Hue |
| Comparative Example 6 | 660 | 1.50 | 1.29 | 0.06 | 0.10 | Cyan |
| Comparative Example 7 | 541 | 1.55 | 1.35 | 0.07 | 0.12 | Magenta |

It is understood from the results shown in Table 2 that the heat-sensitive recording material containing the coupler and the diazonium salts of the present invention has a remarkably improved coloring density without impairing the image light resistance and the image fixing property.

Example 23

Preparation of Microcapsule Liquid 2 parts of the diazonium salt (D-2), 1 part of the compound represented by the following formula (8) and 1 part of the compound represented by the following formula (9) were added and mixed in 5 parts of ethyl acetate.

(8)

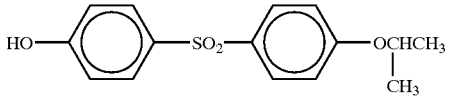

(9)

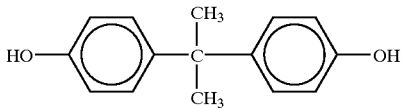

To the resultant solution containing the diazonium salt compound, 3 parts of an isocyanate having a structure of an isocyanurate of TDI (Sumidur FL-2, a trade name, Sumitomo Bayer Urethane Co., Ltd.) and 3 parts of an isocyanate having a structure of a trimethylolpropane adduct of XDI (Takenate D-110N, a trade name, produced by Takeda Chemical Industries, Ltd.) were added and mixed by stirring.

The resultant ethyl acetate solution containing the diazonium salt, the isocyanates and the compounds represented by the formulae (8) and (9) were mixed with an aqueous solution containing 10 parts of water and 1 part of polyvinyl alcohol (PVA217E, produced by Kuraray Co., Ltd.), dissolved therein, and dispersed for emulsification to obtain an emulsion having an average particle diameter of 1.0 μm. 10 parts of water were added to the resulting emulsion, and the isocyanates as a wall forming material were reacted by heating to 40° C. for 3 hours under stirring to obtain microcapsules of an average particle diameter of 1 μm containing the diazonium compound and the compounds represented by the formulae (8) and (9) as a core material.

The capsulation reaction was carried out under reduced pressure of from 53.3 kPa (400 mmHg) to 66.7 kPa (500 mmHg) by an aspirator.

Preparation of Coupler Dispersion

5parts of the coupler (C-1) and 5parts of the base (B-1), triphenylguanidine, were added to 100 parts of a 5% by mass aqueous solution of polyvinyl alcohol, and dispersed in a sand mill for 24 hours to obtain a dispersion having an average particle diameter of 2 μm.

Preparation of Coating Composition

To 10 parts of the capsule liquid of the diazonium salt thus obtained, 25 parts of the coupler dispersion, 10 parts of a 40% by mass dispersion of calcium carbonate (Unibar 70, produced by Shiraishi Industry Co., Ltd.), 5 parts of a 20% by mass dispersion of stearic acid amide, 2 parts of a 40% by mass dispersion of zinc 3,5-di-α-methylbenzylsalicylate and 1 part of a 5% by mass solution of L-ascorbic acid (Vitamin C, produced by Takeda Chemical Industries, Ltd.) were added to make a coating composition.

Production of Duplication Material

The coating composition was coated by using a coating bar on smooth high quality paper (76 g/m$^2$) in a dry weight of 5 g/m$^2$ (0.2 g/m$^2$ in terms of the diazonium compound and 0.02 g/m$^2$ in terms of L-A ascorbic acid) and dried at 50° C. for 3 minutes to obtain a duplication material according to the invention.

Evaluation of Heat Sensitivity

After imagewise exposure, a heat block heated to 100° C. was pressed on the duplication material for 2.5 seconds to conduct development, and the density of the image part was measured by a Macbeth densitometer. The results are shown in Table 3.

Evaluation of Storage Stability

In order to evaluate the storage stability (storage stability before use) of the recording material thus obtained, the recording material was subjected to forced deterioration tests by being left in a dark atmosphere of 40° C. and a relative humidity of 90% (90% RH) and a dark atmosphere of 60° C. and a relative humidity of 30% (30% RH) for a day, and the background densities before and after the tests were measured. The results are shown in Table 3.

Example 24

A duplication material was produced by preparing a coating composition in the same manner as in Example 23 except that the coupler (C-1) used in Example 23 was changed to the coupler (C-2), and the heat sensitivity and the storage stability thereof were evaluated.

Example 25

A duplication material was produced by preparing a coating composition in the same manner as in Example 23 except that the coupler (C-1) used in Example 23 was changed to the coupler (C-29), and the heat sensitivity and the storage stability thereof were evaluated.

Comparative Example 8

A duplication material was produced by preparing a coating composition in the same manner as in Example 23 except that the coupler (C-1') was used instead of the coupler (C-1), and the heat sensitivity and the storage stability thereof were evaluated.

TABLE 3

| | Color Formation Part | | Density of Background Part | | |
|---|---|---|---|---|---|
| | | | Before | 40° C. | 60° C. |
| | Coloring Density | Evaluation | Stability Test | 90% RH after 1 day | 30% RH after 1 day |
| Example 23 | 1.70 | ○ | 0.08 | 0.10 | 0.15 |
| Example 24 | 1.65 | ○ | 0.09 | 0.12 | 0.14 |
| Example 25 | 1.77 | ○ | 0.08 | 0.12 | 0.15 |
| Comparative Example 8 | 1.25 | X | 0.10 | 0.10 | 0.15 |

It is understood from the results shown in Table 3 that the heat-sensitive recording material of the present invention is excellent in stability and coloring density and is good in stability. It is also observed that the heat-sensitive recording material of the present invention rapidly colors by heating after the exposure of the image.

The results of the foregoing Examples and Comparative Examples substantiate the effectiveness of the present invention.

According to the present invention, a process for an azo coupling reaction is provided that has a large coupling reaction rate and an excellent coloring density and exerts high coupling activity using a stable coupler. A recording material containing the coupler having excellent coloring property is also provided that utilizes the process for azo coupling reaction without impairing the storage stability, such as the image light resistance.

What is claimed is:

1. A process for an azo coupling reaction comprising carrying out a coupling reaction of a diazonium salt and a coupler to make said diazonium salt form color, said coupler having one of the structures represented by the following general formulae (1), (2) and (3):

(1)

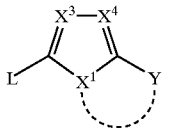

(2)

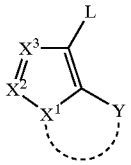

-continued (3)

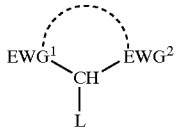

wherein $X^1$, $X^2$, $X^3$ and $X^4$ each independently represents an atomic group necessary for forming a 5-membered aromatic heterocyclic ring; Y represents an amino group, a substituted amino group, a hydroxyl group, an alkoxy group, an alkyl group, which may have a substituent, provided that $X^1$ and Y may be combined to form a heterocyclic ring; L represents a substituent capable of being released as a carbonium ion upon coupling with said diazonium salt; and $EWG^1$ and $EWG^2$each independently represents an electron withdrawing group, provided that $EWG^1$ and $EWG^2$ may be combined to form a heterocyclic ring.

2. The process for an azo coupling reaction of claim 1, wherein said substituent represented by L of said coupler is a substituent represented by the following general formula (4):

$$—CHR^1R^2 \quad (4)$$

wherein at least one of $R^1$ and $R^2$ contains an electron source capable of stabilizing a carbonium ion by resonance, i.e., a heteroatom having an unpaired electron.

3. The process for an azo coupling reaction of claim 2, wherein $EWG^1$ and $EWG^2$ of said coupler having a structure represented by the general formula (3) each is a carbonyl group.

4. The process for an azo coupling reaction of claim 2, wherein said diazonium salt is a benzene diazonium salt represented by the following general formula (5):

(5)

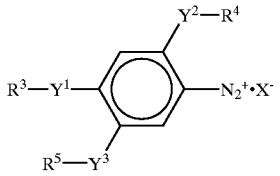

wherein $R^3$, $R^4$ and $R^5$, which may be the same or different, each independently represents an alkyl group, an aryl group, an aralkyl group, an alkenyl group, a heterocyclic group or an acyl group; $Y^1$ represents an oxygen atom, a sulfur atom or an amino group; $Y^2$ represents an oxygen atom or a sulfur atom; $Y^3$ represents an oxygen atom, a sulfur atom or a hydrogen atom, provided that when $Y^3$ represents a hydrogen atom, $R^5$ is not present; and $X^-$ represents an anion.

5. The process for an azo coupling reaction of claim 2, wherein a reaction rate k of said coupling reaction of said diazonium salt and said coupler is 0.1 ($s^{-1}$) or more.

6. The process for an azo coupling reaction of claim 1, wherein said 5-membered heterocyclic ring of said coupler having a structure represented by the general formula (1) or (2) is one of a pyrrole ring, a pyrazole ring and an imidazole ring.

7. The process for an azo coupling reaction of claim 6, wherein said diazonium salt is a benzene diazonium salt represented by the following general formula (5):

(5)

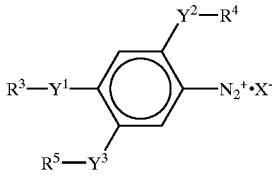

wherein $R^3$, $R^4$ and $R^5$, which may be the same or different, each independently represents an alkyl group, an aryl group, an aralkyl group, an alkenyl group, a heterocyclic group or an acyl group; $Y^1$ represents an oxygen atom, a sulfur atom or an amino group; $Y^2$ represents an oxygen atom or a sulfur atom; $Y^3$ represents an oxygen atom, a sulfur atom or a hydrogen atom, provided that when $Y^3$ represents a hydrogen atom, $R^5$ is not present; and $X^-$ represents an anion.

8. The process for an azo coupling reaction of claim 6, wherein a reaction rate k of said coupling reaction of said diazonium salt and said coupler is 0.1 ($s^{-1}$) or more.

9. The process for an azo coupling reaction of claim 1, wherein $EWG^1$ and $EWG^2$ of said coupler having a structure represented by the general formula (3) each is a carbonyl group.

10. The process for an azo coupling reaction of claim 9, wherein said diazonium salt is a benzene diazonium salt represented by the following general formula (5):

(5)

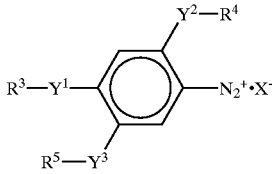

wherein $R^3$, $R^4$ and $R^5$, which may be the same or different, each independently represents an alkyl group, an aryl group, an aralkyl group, an alkenyl group, a heterocyclic group or an acyl group; $Y^1$ represents an oxygen atom, a sulfur atom or an amino group; $Y^2$ represents an oxygen atom or a sulfur atom; $Y^3$ represents an oxygen atom, a sulfur atom or a hydrogen atom, provided that when $Y^3$ represents a hydrogen atom, $R^5$ is not present; and $X^-$ represents an anion.

11. The process for an azo coupling reaction of claim 9, wherein a reaction rate k of said coupling reaction of said diazonium salt and said coupler is 0.1 ($s^{-1}$) or more.

12. The process for an azo coupling reaction of claim 1, wherein said diazonium salt is a benzene diazonium salt represented by the following general formula (5):

(5)

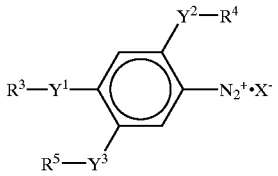

wherein $R^3$, $R^4$ and $R^5$, which may be the same or different, each independently represents an alkyl group, an aryl group, an aralkyl group, an alkenyl group, a heterocyclic group or an acyl group; $Y^1$ represents an oxygen atom, a sulfur atom or an amino group; $Y^2$ represents an oxygen atom or a sulfur atom; $Y^3$ represents an oxygen atom, a sulfur atom or a hydrogen atom, provided that when $Y^3$ represents a hydrogen atom, $R^5$ is not present; and $X^-$ represents an anion.

13. The process for an azo coupling reaction of claim 1, wherein a reaction rate k of said coupling reaction of said diazonium salt and said coupler is 0.1 ($s^{-1}$) or more.

14. A recording material comprising a coupler having one of structures represented by the following general formulae (1), (2) and (3), and a diazonium salt capable of forming color through a coupling reaction with said coupler:

(1)

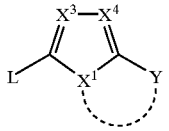

(2)

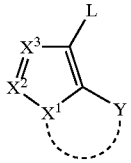

(3)

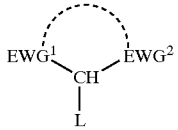

wherein $X^1$, $X^2$, $X^3$ and $X^4$ each independently represents an atomic group necessary for forming a 5-membered aromatic heterocyclic ring; Y represents an amino group, a substituted amino group, a hydroxyl group, an alkoxy group, an alkyl group, which may have a substituent, provided that $X^1$ and Y may be combined to form a heterocyclic ring; L represents a substituent capable of being released as a carbonium ion upon coupling with said diazonium salt; and $EWG^1$ and $EWG^2$ each independently represents an electron withdrawing group, provided that $EWG^1$ and $EWG^2$ may be combined to form a heterocyclic ring.

15. The recording material of claim 14, wherein said substituent represented by L of said coupler is a substituent represented by the following general formula (4):

$$—CHR^1R^2 \quad (4)$$

wherein at least one of $R^1$ and $R^2$ contains an electron source capable of stabilizing a carbonium ion by resonance, i.e., a heteroatom having an unpaired electron.

16. The recording material of claim 14, wherein said 5-membered heterocyclic ring of said coupler having a structure represented by the general formula (1) or (2) is one of a pyrrole ring, a pyrazole ring and an imidazole ring.

17. The recording material of claim 14, wherein $EWG^1$ and $EWG^2$ of said coupler having a structure represented by the general formula (3) each is a carbonyl group.

18. The recording material of claim 14, wherein said diazonium salt is a benzene diazonium salt represented by the following general formula (5):

(5)

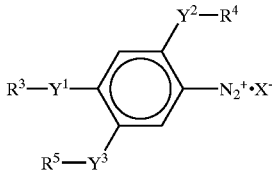

wherein $R^3$, $R^4$ and $R^5$, which may be the same or different, each independently represents an alkyl group, an aryl group, an aralkyl group, an alkenyl group, a heterocyclic group or an acyl group; $Y^1$ represents an oxygen atom, a sulfur atom or an amino group; $Y^2$ represents an oxygen atom or a sulfur atom; $Y^3$ represents an oxygen atom, a sulfur atom or a hydrogen atom, provided that when $Y^3$ represents a hydrogen atom, $R^5$ is not present; and $X^-$ represents an anion.

* * * * *